US008852753B2

(12) United States Patent
Matsumura et al.

(10) Patent No.: US 8,852,753 B2
(45) Date of Patent: Oct. 7, 2014

(54) GALVANIZED STEEL SHEET

(75) Inventors: Kenichiroh Matsumura, Tokyo (JP); Makoto Nakazawa, Tokyo (JP); Masahiro Yui, Tokyo (JP); Takehiro Takahashi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/521,302

(22) PCT Filed: Jul. 9, 2010

(86) PCT No.: PCT/JP2010/061703

§ 371 (c)(1),
(2), (4) Date: Jul. 10, 2012

(87) PCT Pub. No.: WO2012/004889

PCT Pub. Date: Jan. 12, 2012

(65) Prior Publication Data

US 2012/0288734 A1 Nov. 15, 2012

(51) Int. Cl.

| | |
|---|---|
| ***B32B 15/04*** | (2006.01) |
| ***B32B 15/18*** | (2006.01) |
| ***C23C 28/00*** | (2006.01) |
| ***C23C 2/28*** | (2006.01) |
| ***C23C 2/06*** | (2006.01) |
| ***C23C 2/02*** | (2006.01) |

(52) U.S. Cl.

CPC ..... *C23C 2/06* (2013.01); *C23C 28/321* (2013.01); *C23C 28/345* (2013.01); *C23C 2/28* (2013.01); *C23C 2/02* (2013.01)

USPC ..... 428/659; 428/633; 428/336; 428/340

(58) Field of Classification Search

USPC ..... 428/659, 632, 633, 630, 631, 639, 658, 428/684, 685, 687, 212, 213, 215, 216, 219, 428/220, 332, 335, 336, 340, 704, 341, 469, 428/472, 472.1, 472.2, 472.3

See application file for complete search history.

(56) References Cited

U.S. PATENT DOCUMENTS

| | | | | |
|---|---|---|---|---|
| 5,409,553 | A | 4/1995 | Sagiyama et al. | |
| 5,518,769 | A | 5/1996 | Sagiyama et al. | |
| 5,525,431 | A * | 6/1996 | Kanamaru et al. | 428/623 |

FOREIGN PATENT DOCUMENTS

| | | |
|---|---|---|
| EP | 0 473 154 | 3/1992 |
| EP | 1 002 886 | 5/2000 |

(Continued)

OTHER PUBLICATIONS

Machine Translation, Unno et al., JP 08-092714, Apr. 1996.*

(Continued)

*Primary Examiner* — Michael E La Villa
(74) *Attorney, Agent, or Firm* — Kenyon & Kenyon LLP

(57) ABSTRACT

The present invention provides a galvanized steel sheet including: a steel sheet; and a galvanizing layer provided on a surface of the steel sheet; wherein the galvanizing layer includes an amorphous coating layer having an inorganic oxoacid salt and metallic oxide on a surface layer of the galvanizing layer; the galvanizing layer includes a ζ phase and a $\delta_1$ phase; the galvanizing layer includes, by mass, 8 to 13% of Fe; Zn in the metallic oxide exists up to an outermost surface layer of the amorphous layer; and an X-ray diffraction intensity ratio I, which is obtained by dividing an X-ray diffraction intensity of the ζ phase at d=0.126, after removing background intensity, by an X-ray diffraction intensity of the δ1 phase at d=0.126, after removing background intensity, is 0.06 to 0.35.

9 Claims, 7 Drawing Sheets

(56) References Cited

FOREIGN PATENT DOCUMENTS

| | | |
|---|---|---|
| EP | 1 233 265 | 8/2002 |
| EP | 2 495 346 | 9/2012 |
| EP | 2 495 347 | 9/2012 |
| JP | 64-068456 | 3/1989 |
| JP | 03-191045 | 8/1991 |
| JP | 04-000360 | 1/1992 |
| JP | 04-006258 | 1/1992 |
| JP | 04-013855 | 1/1992 |
| JP | 4088196 | 3/1992 |
| JP | 04-176878 | 6/1992 |
| JP | 08-092714 | 4/1996 |
| JP | 2819427 | 10/1998 |
| JP | 2002-012958 | 1/2002 |
| JP | 2003-138361 | 5/2003 |
| JP | 2003-171751 | 6/2003 |
| JP | 2004-190074 | 7/2004 |
| JP | 2006-183090 | 7/2006 |
| JP | 2007-217784 | 8/2007 |
| TW | 200940722 | 10/2009 |
| TW | 200949012 | 12/2009 |

OTHER PUBLICATIONS

International Search Report dated Aug. 25, 2009, issued in corresponding PCT Application No. PCT/JP2009/062599.

International Search Report dated Aug. 17, 2010, issued in corresponding PCT Application No. PCT/JP2010/061703.

Taiwanese Notice of Allowance, dated Feb. 20, 2013, issued in corresponding Taiwanese application No. 099122493, with an English translation of the Search Report only.

Canadian Office Action, dated May 16, 2013, issued in corresponding Canadian application No. 2786639.

Jiang et al., "Effect of galvannealing process on powder residence and microstructure of galvannealing coatings of ultra-low carbon steel sheets," Gangtic Yanjiu Xucbao (2012), 22(3) pp. 33-38 (Abstract only).

Extended European Search Report dated Dec. 5, 2013 issued in corresponding EP Application No. 10854443.8.

* cited by examiner

GALVANIZED STEEL SHEET

This application is a national stage application of International Application No. PCT/JP2010/061703, filed Jul. 9, 2010.

TECHNICAL FIELD OF THE INVENTION

The present invention relates to a galvanized steel sheet.

BACKGROUND ART

Galvanized and galvannealed steel sheets (GA), which are excellent in continuous spot welding and corrosion resistance after painting, are used in a large amount as steel sheets for automobiles. Galvanized and galvannealed steel sheets initially had problems of "powdering" which is an phenomenon that a stiff galvanizing layer is crushed in powder form and exfoliated during press forming in a case that the galvanizing layer is too much alloyed (that is, in a case that the Γ phase that includes body-centered cubic crystal of Zn and Fe intermetallic compound ($Fe_3Zn_{10}$) with 20-28 mass % of Fe is plenty) to make the galvanizing layer stiff. Further, as for a damage of the galvanizing layer, there were problems of "flaking" which is a phenomenon that a galvanizing layer is flaked and exfoliated during press forming under the high surface pressure, in a case that the galvanizing layer is insufficiently alloyed (that is, in a case that the ζ phase that includes monoclinic crystal of Zn and Fe intermetallic compound ($FeZn_{10}$) with 5.5-6.2 mass % of Fe is plenty) to induce an adhesion between the galvanizing layer and the die or the punch. However, due to advanced galvanizing layer controlling technology and pressing technology, galvanized and galvannealed steel sheets are being used without significant problems. In order to increase the powdering resistance, Γ phase generation in an interface between a galvanizing layer and steel substrate is usually reduced in amount. Meanwhile, in order to increase the flaking resistance, ζ phase in a galvanizing surface layer is usually reduced in amount.

Patent Document 1 discloses a galvanized and galvannealed steel sheet having 1.0 μm or less of Γ phase in an interface between a galvanizing layer and a steel substrate, the galvanizing layer having a galvanizing surface layer which does not include a η phase, which is a hexagonal Zn phase including not more than 0.003 mass % of Fe, or the above-mentioned ζ phase.

Patent Document 2 discloses a galvanized and galvannealed steel sheet having Γ phase in a thickness of not more than 0.5 μm, and having a galvanizing layer which does not include η phase or ζ phase at the galvanizing surface layer.

Patent Document 3 discloses a galvanized and galvannealed steel sheet having a galvanizing layer on a surface of the steel sheet and having a surface roughness Rmax of not greater than 8 μm.

Patent Document 4 discloses a galvanized and galvannealed steel sheet wherein the surface coverage of the ζ phase and the X-ray diffraction intensity ratio between the ζ phase and other phases are determined to be in specific ranges.

Another approach to improve press formability is a series of techniques by providing a lubricating coat on a surface of the galvanized steel sheet instead of controlling the galvanizing layer as described above.

Patent Document 5 discloses a galvanized steel sheet including coats I and II on a galvanizing surface layer, wherein the coat I has an adhesion-preventing function and has one or more metal oxides/hydroxides selected from Mn, Mo, Co, Ni, Ca, Cr, V, W, Ti, Al and Zn as a major component, and wherein the coat II has a rolling-lubricating function and has one or two kinds of oxygen acids selected from P and B as a major component. The coat II gradually increases in concentration toward an interface with galvanizing layer, and the coat II gradually increases in concentration toward a surface of the sheet.

Patent Document 6 discloses a galvanized and galvannealed steel sheet having a flat portion on a surface of an iron-zinc alloy galvanizing layer, the flat portion being provided with an oxide layer which includes: a Zn-based oxide as a major component; a thickness of not less than 8 nm and not more than 200 nm; and an interface width of not less than 25 nm and not more than 500 nm.

Patent Document 7 discloses a galvanized steel sheet which includes a crystalline phosphated coat formed on a surface.

RELATED ART DOCUMENT

Patent Document

[Patent Document 1] Japanese Unexamined Patent Application, First Publication No. H01-068456

[Patent Document 2] Japanese Unexamined Patent Application, First Publication No. H04-013855

[Patent Document 3] Japanese Unexamined Patent Application, First Publication No. H03-191045

[Patent Document 4] Japanese Unexamined Patent Application, First Publication No. H08-092714

[Patent Document 5] Japanese Unexamined Patent Application, First Publication No. H04-176878

[Patent Document 6] Japanese Unexamined Patent Application, First Publication No. 2003-171751

[Patent Document 7] Japanese Unexamined Patent Application, First Publication No. 2007-217784

DISCLOSURE OF THE INVENTION

Problem to be Solved by the Invention

However, in the galvanized and galvannealed steel sheets disclosed in Patent Document 1 and Patent Document 2, neither η phase nor ζ phase exists in the galvanizing surface layer and the thickness of Γ phase is small. These galvanizing layers are therefore formed by a substantially single $\delta_1$ phase that includes a hexagonal crystal of Zn and Fe intermetallic compound ($FeZn_7$) with 7-11.4 mass % of Fe. Although these disclosed steel sheets have an ideal structure of galvanizing layer to control both powdering resistance and flaking resistance, slidability during press forming is lower than those of the steel sheets disclosed in Patent Document 5, Patent Document 6, and Patent Document 7 which include a lubricating coat provided on a surface of a galvanized steel sheet.

The galvanized and galvannealed steel sheet disclosed in Patent Document 3 includes ζ phase existing near the galvanizing surface layer and has a certain roughness imparted to the galvanizing surface layer in order to compensate for reduced flaking resistance. The effect, however, is limited. The galvanized and galvannealed steel sheet disclosed in Patent Document 4 also includes ζ phase in order to improve chemical conversion treatability and cathodic electrodeposition coatability. In terms of both the powdering resistance and the flaking resistance, however, the galvanized and galvannealed steel sheet disclosed in Patent Document 4 has no ideal structure of galvanizing layer structure. The galvanized and galvannealed steel sheet disclosed in Patent Document 4 is inferior to those disclosed in Patent Document 5, Patent Document 6, and Patent Document 7 in slidability during press forming.

Meanwhile, as to the galvanized and galvannealed steel sheet disclosed in Patent Document 5, the galvannealed steel sheet to which a lubricating coat is provided on the surface layer of the galvanized steel sheet can achieve preferable slidability during press forming irrespective of whether the ζ phase exists in the galvanizing surface. As a result, the occurrence of fracture is suppressed even if a large wrinkle suppressing force (blank holding force, BHF) is applied at the time of press forming. However, at the same time, a large wrinkle suppressing force is required to eliminate the occurrence of wrinkles. That is, even if the lower limit of the BHF with which fractures occur increases, the lower limit of the wrinkle suppressing force which is required for eliminating the wrinkle increases. Therefore, the BHF range in which neither wrinkles nor fractures occur, that is, the range for achieving press forming still remains the same as those of the related art.

The galvanized and galvannealed steel sheets disclosed in Patent Document 6 and Patent Document 7 can achieve preferable slidability during press forming irrespective of whether the ζ phase exists in the galvanizing surface layer. The effect, however, is smaller than that of the steel sheet disclosed in Patent Document 5. The range for achieving press forming still remains the same as those of the related art.

As described above, the related arts are excellent in both of powdering resistance and flaking resistance, or slidability during press forming, but fail to extend the employable BHF range (wrinkle suppressing force), that is, the range for achieving press forming. It is therefore desirable to further improve press formability, that is, to extend the BHF (wrinkle suppressing force) range that is the range for achieving press forming in which neither wrinkles nor fractures occur.

Means for Solving the Problem

For solving the foregoing problems, the present invention employs the following.

(1) A first aspect of the present invention is a galvanized steel sheet including: a steel sheet; and a galvanizing layer in an amount of not less than 20 g/m$^2$ and not more than 100 g/m$^2$, the galvanizing layer being provided on a surface of the steel sheet and containing Zn as a main component; wherein the galvanizing layer includes an amorphous coating layer having an inorganic oxoacid salt and metallic oxide on a surface layer of the galvanizing layer; the galvanizing layer includes a ζ phase and a $\delta_1$ phase; the galvanizing layer includes, by mass, 8 to 13% of Fe; Zn in the metallic oxide exists up to an outermost surface layer of the amorphous layer; and an X-ray diffraction intensity ratio I, which is obtained by dividing an X-ray diffraction intensity of the ζ phase at d=0.126, after removing background intensity, by an X-ray diffraction intensity of the δ1 phase at d=0.126, after removing background intensity, is 0.06 to 0.35.

(2) In the galvanized steel sheet according to (1), the galvanizing layer may include a Γ phase having an average thickness of 1.5 gm or less.

(3) In the galvanized steel sheet according to (1), the galvanizing layer may include Al in an amount of not less than 0.10 g/m$^2$ and not more than 0.25 g/m$^2$.

(4) In the galvanized steel sheet according to (1), the galvanizing layer may include Ni in an amount of more than 0 g/m$^2$ and not more than 0.40 g/m$^2$.

(5) In the galvanized steel sheet according to (4), the galvanizing layer includes Al in an amount of not less than 0.15 g/m$^2$ and not more than 0.45 g/m$^2$.

(6) In the galvanized steel sheet according to any one of (1) to (5), the inorganic oxoacid salt may include at least one of P and B.

(7) In the galvanized steel sheet according to any one of (1) to (5), the metallic oxide may include at least one of metallic oxides of Mn and Al.

(8) In the galvanized steel sheet according to any one of (1) to (5), a total amount of P and B in the inorganic oxoacid salt may be not less than 1 mg/m$^2$ and not more than 250 mg/m$^2$; and a total amount of Mn, Mo, Co, Ni, Ca, V, W, W, Ti and Ce in the metallic oxide including Zn may be not less than 1 mg/m$^2$ and not more than 250 mg/m$^2$.

(9) In the galvanized steel sheet according to any one of (1) to (5), Zn existing in the outermost layer of the amorphous coating layer is provided so that a chemical compound of a phosphorus-containing oxoacid and a zinc becomes a major component.

Effects of the Invention

According to the configuration described in (1), a component with an adhesion-preventing function, an inorganic oxoacid salt with a rolling-lubricating function, and a metallic oxide exist in a uniformly mixed manner in an amorphous coating layer. Further, as to the structure of the galvanizing layer, a predetermined amount of the ζ phase is made to exist in the surface layer. A synergistic effect generated by the lubricating coat and the structure of the galvanizing layer can provide a hot-dipped galvanized steel sheet that is excellent in lubricity and chemical conversion treatability. The steel sheet also has an extended range for achieving press forming as compared with those of the related art. Then, a higher yield can be obtained in the press forming of the steel sheets for automobile bodies more efficiently than in the related art. In addition, the possibility of the die and punch design can be expanded to produce variously designed press formed articles. Therefore, the commercial value of automobiles can be increased.

According to the configuration described in (2), a galvanized steel sheet having preferable powdering resistance can be provided.

According to the configuration described in (3), since the structure of galvanizing layer according to (1) can be obtained easily, a galvanized steel sheet having an extended range for achieving press forming can be provided.

According to the configurations described in (4) and (5), since generation of the ζ phase in the galvanizing layer can further be controlled, a galvanized steel sheet having further extended range for achieving press forming can be provided.

According to the configurations described in (6), (7), and (8), since the structure of galvanizing layer according to (1) can be obtained easily, a galvanized steel sheet having a further extended range for achieving press forming can be provided.

According to the configuration described in (9), since appropriate lubricity is obtained, a galvanized steel sheet having a further extended range for achieving press forming can be provided.

EMBODIMENT OF THE INVENTION

Figure 1:
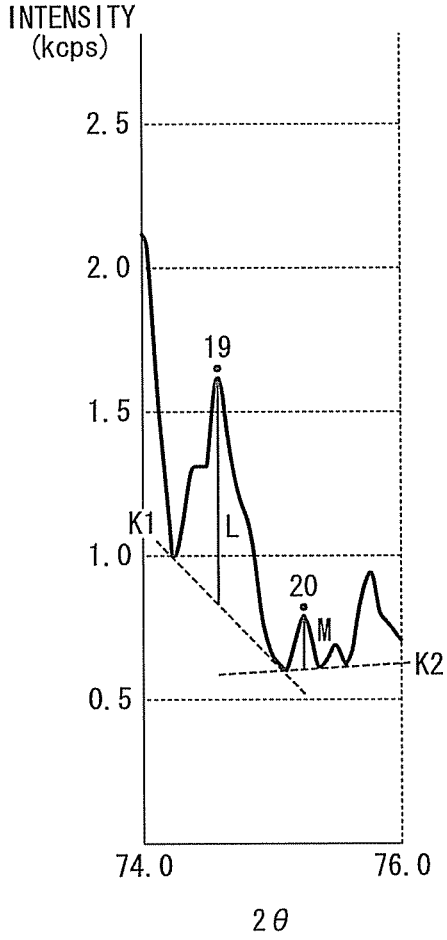
FIG. 1 is a graph illustrating removal of background intensity during obtaining an I value on the basis of a result of X-ray diffraction analysis of a galvanized steel sheet using an equation of the X-ray diffraction intensity ratio I of ζ phase and $\delta_1$ phase in a galvanizing layer.

The present inventors have studied a technique to provide a lubricating coat on a surface of a galvanized steel sheet as described in Patent Document 5 in order to solve the related art problems. In the related art, it was considered, as suitable conditions to provide an extended compression range for achieving press forming, that the steel sheet has a coat with an adhesion-preventing function which gradually increases concentration toward an interface with a galvanizing layer, and a coat with a rolling-lubricating function which gradually increases concentration toward a surface of the coating layer, i.e., toward an outer surface of the galvanizing layer. If the related art concept is applied to a galvanized and galvannealed steel sheet, the steel sheet has greater slidability although the galvanizing layer structure is disadvantageous to slidability. Therefore, it has been considered that the galvanizing layer structure has no influence on the slidability. The inventors have studied, instead of sticking to these two of related art concepts, about an ideal structure of galvanizing layer structure and an ideal structure of coat to provide an extended range of a wrinkle suppressing force, that is, an extended range for achieving press forming in which neither wrinkles nor fractures occur. As a result, it has been found that the range of the applicable wrinkle suppressing force, that is, the range for achieving press forming can be extended by a synergistic effect of a lubricating coat and a galvanizing layer structure, wherein the lubricating coat has a component with an adhesion-preventing function and a component with a rolling-lubricating function which are mixed together, and wherein the galvanizing layer structure includes a predetermined amount of the ζ phase in the surface layer.

The suitable structure of coat structure of the related art exhibits great lubricity even when low surface pressure is applied, because of a galvanizing surface including a highly concentrated rolling-lubricating component and because of a sliding interface provided between the rolling-lubricating component and the adhesion-preventing component. The related art therefore has a deficiency that wrinkles are likely to occur. This deficiency is eliminated by distributing both the rolling-lubricating component and the adhesion-preventing component in the lubricant coat. However, as described in Patent Document 5, with such a countermeasure only, there is a problem that the limit surface pressure for occurrence of galling becomes low when worked under high surface pressure, which may be disadvantageous to the occurrence of fractures during press forming. Then, the inventors studied to impart an equivalent adhesion-preventing function by making a coat stiffer than that of the related art. As a result, it was discovered that the limit surface pressure for the occurrence of galling is improved and the lower limit force (β) with which a fracture occurs during press forming is increased by making a certain amount of the ζ phase having relatively high reactivity exist in the galvanizing surface layer and taking a larger amount of Zn in the lubricating coat using a Zn dissolution reaction from the galvanizing surface layer so that Zn exists even in the outermost layer of the coating layer. From this knowledge, the inventors found that together with lowering the below-mentioned lower limit wrinkle suppressing force (α) which is required for eliminating wrinkles, the initial object of extending the compression range for achieving press forming can be achieved. It was also found that Zn in the coating outermost layer which includes a chemical compound of phosphorus-containing oxoacid and zinc as a major component may provide further suitable lubricity. It is important to appropriately control the amount of the remaining ζ phase, since an excessively large amount of the remaining ζ phase may impair the slidability and may cause fractures.

The inventors further studied and found that, in order to make a certain amount of the ζ phase exist in the galvanizing surface layer, it is preferred to employ a heating pattern of "rapidly heating at a high temperature and then cooling by natural cooling or gas-water cooling" in a galvannealing (alloying) process. The inventors also found that, in order to have the component with the adhesion-preventing function, the component with the rolling-lubricating function and Zn exist in mixed state in the coating layer and to have Zn exist in the outermost layer of the coating layer, a coat is preferably formed with a treating solution containing an inorganic oxoacid salt and a metallic oxide. The inventors further found that it was advantageous to form the coat by roll coating while appropriately controlling the concentration in the treating solution and the sheet temperature immediately just before the process.

Hereinafter, embodiments of the present invention will be described in detail.

First, components of a galvanized steel sheet according to first embodiment of the present invention will be described in detail. The galvanizing layer according to the present embodiment includes Zn as a major component, and Fe in a content of not less than 8% and not more than 13% by mass.

Here, "includes Zn as a major component" means a state in which Zn is included in the amount of not less than 50% by mass.

If the Fe content in the galvanizing layer is less than 8% by mass, because of insufficient alloy forming, corrosion resistance after painting becomes poor and the excessively large amount of the ζ phase may impair slidability to generate flaking during press forming. On the other hand, if the Fe content exceeds 13% by mass, the Γ phase becomes thick to impair powdering resistance. In order to provide higher flaking resistance, powdering resistance and corrosion resistance after painting, the Fe content is preferably kept not less than 8.5% by mass and not more than 12.5, more preferably, not less than 9% by mass and not more than 12% by mass.

If the steel sheet is used for automobiles, the amount of the galvanizing layer is preferably not less than 20 g/m$^2$ and not more than 100 g/m$^2$, for one surface. If the amount of the galvanizing layer is less than 20 g/m$^2$, corrosion resistance becomes insufficient, and 30 g/m$^2$ or more is more preferable. If the amount of the galvanizing layer exceeds 100 g/m$^2$, continuous spot weldability becomes low, and 70 g/m$^2$ or less is more preferable.

In order to keep satisfactory powdering resistance, the thickness of the Γ phase is preferably not more than 1.5 μm, more preferably not more than 1 μm, and further preferably 0.8 μm.

If the amount of the galvanizing layer is not less than 20 g/m$^2$ and not more than 100 g/m$^2$, the total Al concentration in the galvanizing bath should be in a range of not less than 0.11% by mass and not more than 0.15% by mass for properly alloying the coating layer. If the total Al concentration in the galvanizing bath is lower than 0.11% by mass, the alloying process becomes out of control and leads to overalloy. If the total Al concentration in the galvanizing bath is higher than 0.15% by mass, delayed alloying may cause deterioration in manufacturing efficiency. With the above conditions, the total Al amount in the galvanizing layer, i.e., the total Al amount derived from the conditions of the barrier layer and the galvanizing bath of the initial alloying, falls within a range of not less than 0.10 g/m$^2$ and not more than 0.25 g/m$^2$. The amount of Al in the galvanizing layer is preferably controlled to be not less than 0.13 g/m$^2$ and not more than 0.22 g/m$^2$, and more preferably, mpt less than 0.15 g/m$^2$ and not more than 0.20 g/m$^2$.

Regarding the ratio of the ζ phase and the $\delta_1$ phase in the galvanizing layer, the X-ray diffraction intensity ratio I of these ζ phase and $\delta_1$ phase is set to be in a range of not less than 0.06 and not more than 0.35, when the X-ray diffraction intensity ratio I is represented by the following Equation (1).

$$I=\zeta(d=0.126\text{ nm})/\delta_1(d=0.127\text{ nm}) \quad (1)$$

In Equation (1), ζ(d=0.126 nm) represents the value of the X-ray diffraction intensity of the ζ phase when the interplanar spacing distance (d) is 0.126 nm. Further, $\delta_1$ (d=0.127 nm) represents the value of the X-ray diffraction intensity of $\delta_1$ phase when the interplanar spacing distance (d) is 0.127 nm.

Since the ζ phase contains a large amount of zinc when compared with that of the $\delta_1$ phase, small value of the X-ray diffraction intensity ratio I means that the amount of zinc in the galvanizing layer is small, and as a result, the adhesion to a die or a punch can be reduced and the slidability improves. If the X-ray diffraction intensity ratio I is lower than 0.06, slidability is excessively high and the lower limit wrinkle suppressing force (α) required for eliminating wrinkles increases, and at the same time, the amount of Zn taken into the amorphous coating layer including an inorganic oxoacid salt and a metallic oxide by dissolving from the galvanizing surface layer decreases, thus, the limit of the wrinkle suppressing force with which a fracture occur decreases, thereby narrowing the range for achieving press forming. If the X-ray diffraction intensity ratio I is higher than 0.35, the slidability is insufficient and the lower limit wrinkle suppressing force (α) which is required for eliminating wrinkles decreases, but at the same time, the lower limit wrinkle holding force (β) with which a fracture is generated also decreases, thus, the range for achieving press forming is also narrowed in this case. It is preferable for the X-ray diffraction intensity ratio to be in a range of not less than 0.10 and not more than 0.35, and more preferably, in a range of not less than 0.15 and not more than 0.30.

The X-ray diffraction intensity of ζ (d=0.126 nm) and the X-ray diffraction intensity ratio of $\delta_1$ (d=0.127 nm) are the values after removal of the background intensity. A process of removing the background intensity will be illustrated in FIG. 1. In FIG. 1, the horizontal axis represents the incidence angle of the X-ray and the vertical axis represents diffraction intensity.

In FIG. 1, K1 is a line that represents the background intensity having a peak 19 corresponding to the $\delta_1$ phase and K2 is a line that represents the background intensity having a peak 20 corresponding to the ζ phase. Further, L is a line that represents intensity of $\delta_1$ (d=0.127 nm) after removal of the background intensity in the $\delta_1$ phase and M is a line that represents intensity of ζ (d=0.126 nm) after removal of the background intensity in the ζ phase.

Next, components of a galvanized steel sheet according to second embodiment of the present invention will be described in detail. The galvanizing layer according to the present embodiment includes Zn as a major component, Fe in a content of not less than 8% and not more than 13% by mass, Al in an amount of not less than 0.15 g/m$^2$ and not more than 0.45 g/m$^2$, and Ni in an amount of more than 0 g/m$^2$ and not more than 0.40 g/m$^2$.

In the second embodiment, the steel sheet is pre-plated with a small amount of Ni and then immersed in a hot-dip galvanizing bath with an Al concentration higher than that in the first embodiment to galvanize the same. The steel sheet is thus galvanized in order to further control the generation of the phase. According to a Zn—Al—Fe ternary alloy phase diagram, the phase is not likely to generate and the 6 phase is likely to generate in a galvanizing solution of higher Al concentration. If the Al concentration in the galvanizing bath is simply increased, many Fe—Al barrier layers may generate in an interface with steal substrate and thus the alloying process is delayed, thereby lowering manufacturing efficiency. In order to prevent this phenomenon, the steel sheet is pre-plated with a small amount of Ni and then immersed in a galvanizing bath in which the pre-plated Ni and Al in the bath are made to react with each other near an interface with the steel sheet. In this manner, Al concentration near the interface is lowered and the amount of the Fe—Al barrier layer generated at the interface is controlled so as not to be excessively large. Since Al concentration in the deposit galvanizing layer is high, the phase is not likely to generate during alloying.

The amount of Ni in the galvanizing layer is determined to be more than 0 g/m$^2$ and not more than 0.40 g/m$^2$ on the basis of an appropriate range of the amount of Ni to be pre-plated. A suitable amount of Ni for pre-plating is not less than 0.10 g/m$^2$ and not more than 0.50 g/m$^2$. When the pre-plated steel sheet is immersed in a hot-dip galvanizing bath, the pre-plating is partly dissolved in the galvanizing bath and removed. Thus, as the amount of Ni remaining in the galvanizing layer, more than 0 g/m$^2$, or more preferably, more than 0.07 g/m$^2$, and not more than 0.40 g/m$^2$ is determined. It should be noted that if the amount of pre-plating Ni is more than 0.10 g/m$^2$, generation of unplated portions can be eliminated. Meanwhile, if the amount of the pre-plating Ni exceeds 0.50 g/m$^2$, the reaction of Ni and Al in the bath becomes unfortunately excessively rapid and as a result, an uneven barrier layer is formed to impair the appearance of the produced alloy.

The amount of Al in the galvanizing layer is determined to be not less than 0.15 g/m$^2$ and not more than 0.45 g/m$^2$ on the basis of an appropriate range of Al concentration in the galvanizing bath. If the amount of the pre-plating Ni is not less than 0.10 g/m$^2$ and not more than 0.50 g/m$^2$, the total Al concentration in the galvanizing bath should be in a range of not less than 0.16% by mass and not more than 0.20% by mass. If the Al concentration in the galvanizing bath is less than 0.16% by mass, the alloying process becomes out of control and leads to overalloy. If the Al concentration in the galvanizing bath is more than 0.20% by mass, delayed alloying may cause deterioration in manufacturing efficiency. If the amount of the galvanizing layer is not less than 20 g/m$^2$ and not more than 100 g/m$^2$, the total Al amount in the galvanizing layer, i.e., the total Al amount derived from the barrier layer and the galvanizing bath of the initial alloying is in a range of not less than 0.15 g/m$^2$ and not more than 0.45 g/m$^2$.

In the second embodiment, when compared with the first embodiment, the total Al concentration in the galvanizing bath can be increased as described above, and since the $\zeta$ phase is hard to be generated and $\delta_1$ phase is likely to be generated, the value of the X-ray diffraction intensity ratio I can be controlled to be lower.

Next, components of the lubricating coat will be described in detail. In both the first and second embodiments, the lubricating coat formed on the surface of the galvanizing layer is an amorphous coating layer of an inorganic oxoacid salt and a metallic oxide.

Examples of a suitable inorganic oxoacid salt that can be used for forming the coat in the first and second embodiments include oxygen acid containing P and a salt thereof. Examples of other materials include boric acid, which is oxygen acid containing P, and a salt thereof These may be used alone or in mixture thereof. The mixture preferably includes the oxygen acid containing P. Further, the mixture may include oxide colloids of Si, Al, Ti and the like. It is considered that these materials achieve lubricating function, basically due to rolling particles crushed at the time of press forming.

Meanwhile, the metallic oxide may be an oxide or hydroxide of Zn, Al, Ni, Mn, Mo, Co, Ni, Ca, V, W, Ti, Ce, and the like. Among these components added to a reaction solution, Zn, Al and Ni are taken into the lubricating coat when Zn, Al and Ni are dissolved from the galvanizing layer to the reaction solution. Zn is an especially important component to reinforce the function to prevent the galvanizing layer from being adhered to the die and punch. These components taken into the lubricating coat are detectable in depth directional atom analysis by AUGER electron spectroscopy. Existence of Zn in the coat outermost layer can be detected, without sputtering, through detection of Zn by elemental analysis on a sample surface by AUGER electron spectroscopy and X-ray photoelectric spectroscopy.

The amount of each component of the inorganic oxoacid salt as the total contents of P and B, and the metallic oxide as the total contents of Zn, Al, Ni, Mo, Co, Ni, Va, V, W, Ti and Ce is suitably not less than 1 mg/m$^2$ and not more than 250 mg/m$^2$. If the amount of each component is less than 1 mg/m$^2$, effects of the component are insufficient. If the amount of each component is more than 250 mg/m$^2$, an adverse effect is made to the chemical conversion treatability. A more preferred amount of each component is not less than 3 mg/m$^2$ and not more than 150 mg/m$^2$.

The lubricating coat significantly differs from the related art in that the inorganic oxoacid salt and the metallic oxide which includes Zn exist in the lubricating coat and that Zn oxides are provided even in the outermost layer of the coating layer.

In the suitable technique disclosed in Patent Document 5, a P-containing component with a rolling-lubricating function has increased concentration toward a surface of the coating layer, and a Mn-containing component with an adhesion-preventing function has strong concentration at the interface with steel substrate in the coating layer. The results of the glow discharge spectroscopy analysis are illustrated in a drawing.

Figure 2A:
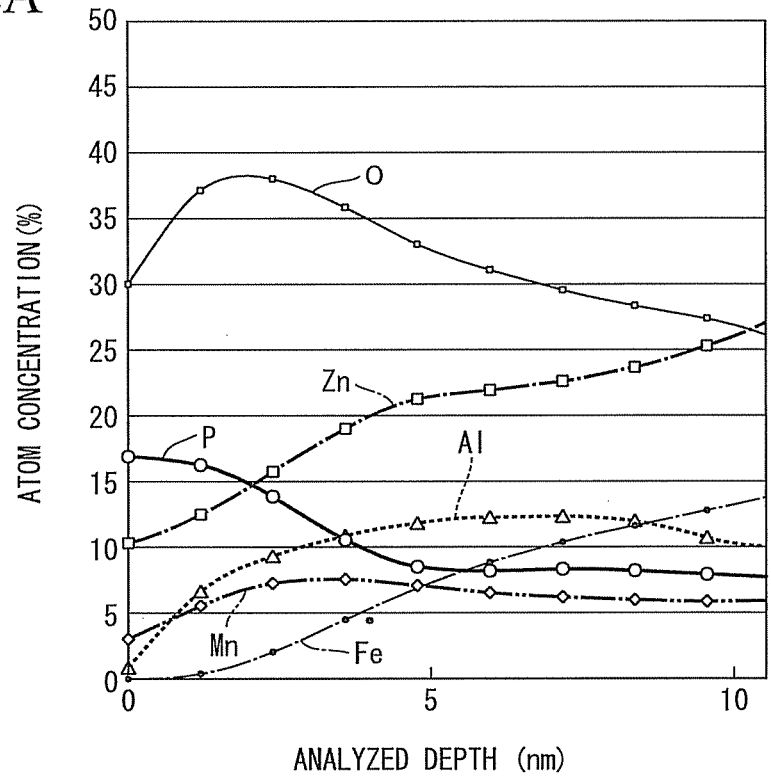
FIG. 2A is a graph illustrating the results of depth analysis by AUGER electron spectroscopy of a lubricating coat of a galvanized steel sheet according to a first embodiment of the present invention.
Figure 2B:
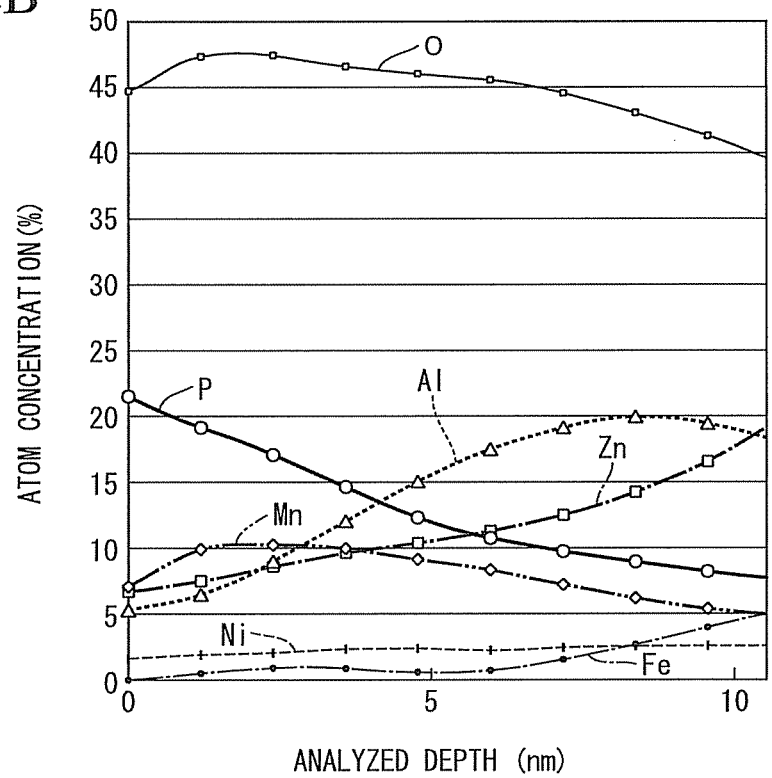
FIG. 2B is a graph illustrating the results of depth analysis by AUGER electron spectroscopy of a lubricating coat of a galvanized steel sheet according to a second embodiment of the present invention.

For comparison with the related art, the results of the depth analysis by AUGER electron spectroscopic analysis corresponding to the first and the second embodiments are illustrated in FIGS. 2A and 2B. The analysis results relating to the technique disclosed in Patent Document 5 and the analysis results according to the first and the second embodiments will be compared. First, in the technique disclosed in the related art patent Document 5, the P-containing component and the Mn-containing component have peaks at explicitly different positions. The Zn exists only in the inner layer of the lubricating coat. On the other hand, the present invention includes Zn in the lubricating coat in a significantly higher amount than that of the related art and includes Zn existing even in the outermost layer of the lubricating coat.

That is, the galvanized steel sheet according to the present embodiment differs from the related art in that the Zn component exist even in the outermost layer of the lubricating coat. With this configuration of the coat, the range for achieving press forming can be expanded.

Figure 4:
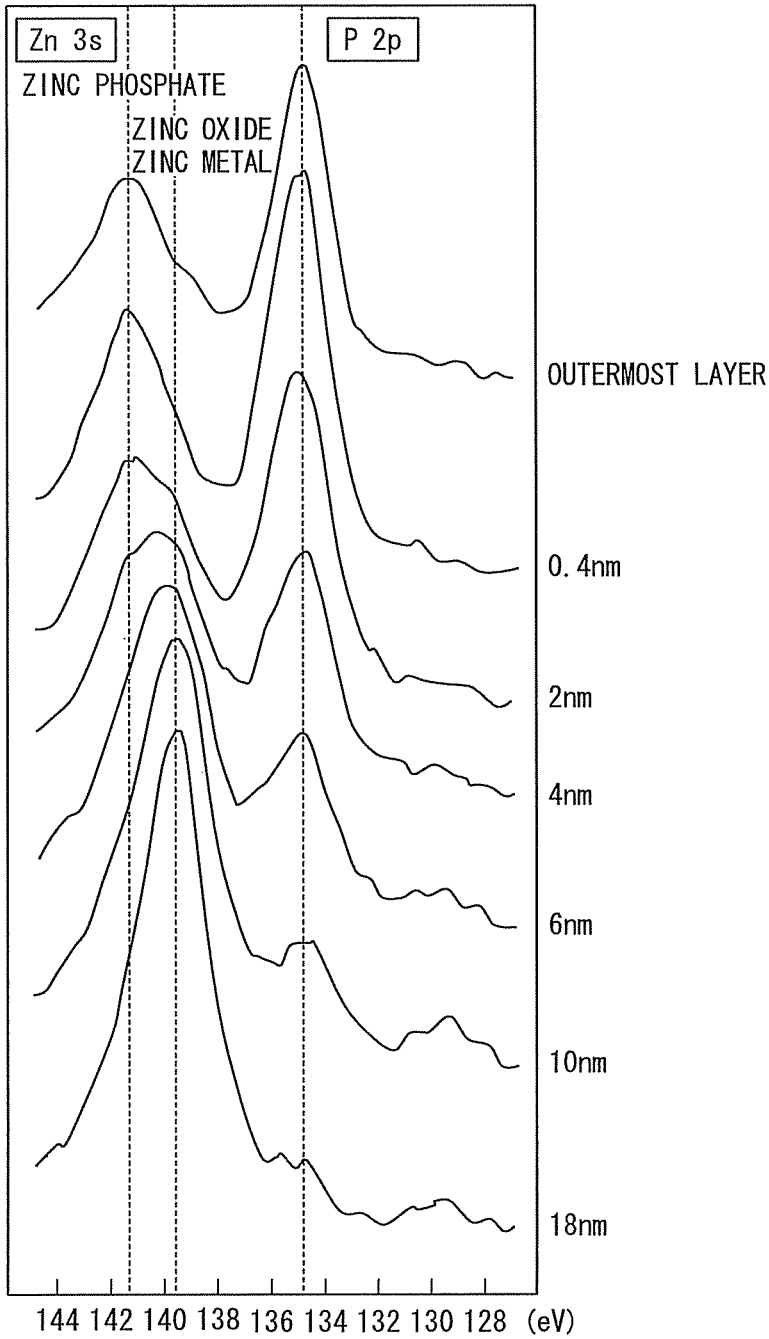
FIG. 4 is spectra of 3s level Zn and 2p level P during a state analysis of a coat surface in the depth direction by X-ray photoelectron spectroscopy.
Figure 5:
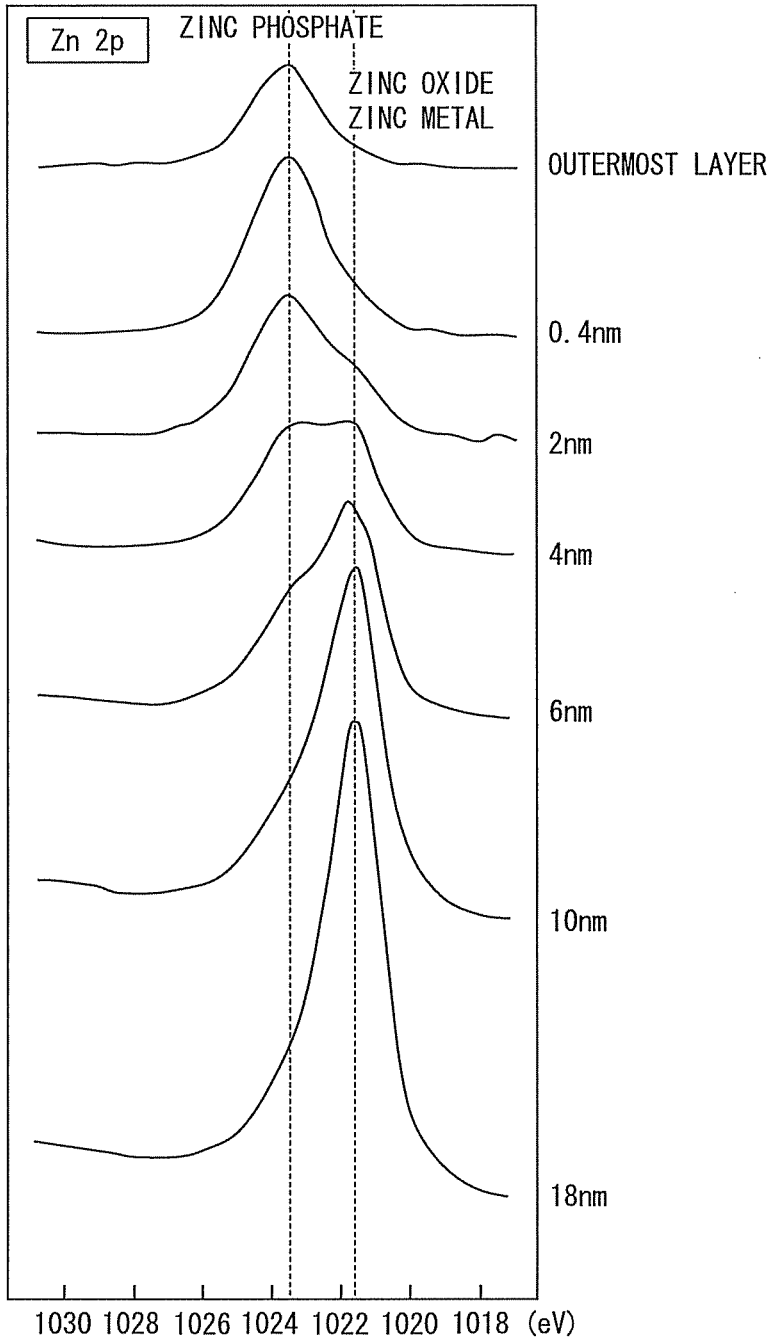
FIG. 5 is a spectrum of 2p level Zn during a state analysis of the coat surface in the depth direction by X-ray photoelectron spectroscopy.
Figure 6:
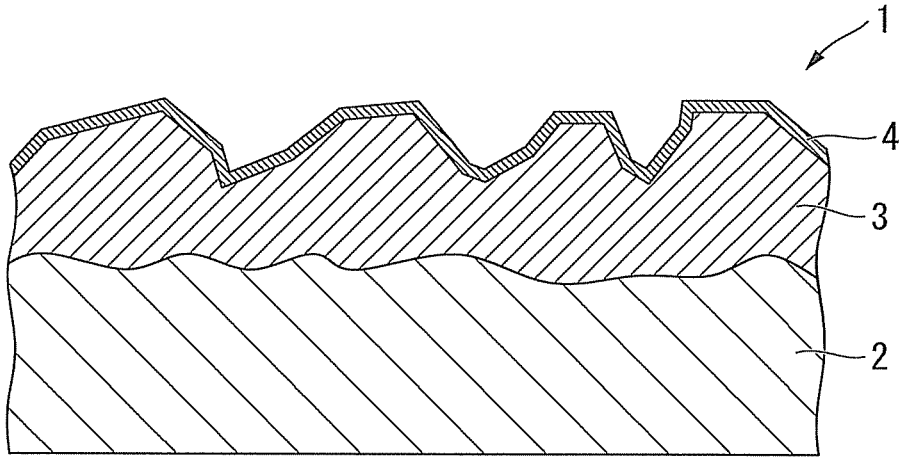
FIG. 6 is a schematic diagram illustrating a structure of the galvanized steel sheet.

Here, Zn in the lubricating coat may be generated so that the chemical compound of phosphorus-containing oxoacid and Zn become major components (50% or more). In other words, Zn in the outermost layer may be majorly (50% or more) generated so as to be presented in a state of a chemical compound of phosphorus-containing oxoacid and zinc (salt). The state of Zn in the coat is identified by X-ray photoelectron spectroscopy. Spectroscopic analysis was conducted by, using an X-ray photoelectron spectrometer PHI5600 available from Ulvac-Phi Inc., sputtering the coat surface at 2 nm (in terms of $SiO_2$) a minute in an analyzing area of having a diameter 0.8 mm at an Ar pressure of $10^{-2}$ Pa and accelerating voltage of 4 kV. The results of the spectroscopic analysis with an electrostatic hemisphere analyzer using an Alka X-ray as the X-ray source while varying the sputtering time are illustrated in FIGS. 4 and 5. FIG. 4 illustrates 2p spectra P and 3s spectra Zn in a region from the outermost layer to a depth of 18 nm. The horizontal axis represents the binding energy (eV). It is understood that the major component is a chemical compound of phosphorus-containing oxoacid and zinc in a region from the outermost layer to a depth of 2 nm, is a mixture of substantially the same amount of zinc phosphate, a chemical compound of phosphorus-containing oxoacid and zinc, and a zinc oxide and zinc metal are substantially the same amount at the depth of 4 nm, and the major component is a zinc oxide and zinc metal in a region from a depth of 6 nm to 18 nm. FIG. 5 illustrates a 2p spectrum of Zn of the same sample. The horizontal axis represents binding energy (eV). Similarly, it is understood that the major component is a chemical compound of phosphorus-containing oxoacid and zinc in a region from the outermost layer to a depth of 2 nm, a chemical compound of phosphorus-containing oxoacid and zinc, a zinc oxide and a zinc metal are substantially the same amount at the depth of 4 nm, and the major component is a zinc oxide and zinc metal in a region from a depth of 6 nm to 18 nm.

Next, manufacturing conditions of the galvanized steel sheet according to the embodiments of the present invention will be described. Conditions regarding the galvanizing layer will be described first.

In this embodiment, a predetermined amount of the phase is made to exist in the galvanizing layer. The thickness of the Γ phase is determined to be not more than 1.5 μm and preferably not more than 1 μm, and further preferably not more than 0.8 μm.

The first aspect is to employ a heating pattern of "rapidly heating at a high temperature using an electric induction heater or the like and then natural cooling, gas-water cooling, or the like" during an alloying process with the total Al concentration in the galvanizing bath being not less than 0.11% by mass and not more than 0.15% by mass. It is effective that the top temperature for alloying is higher than the peritectic temperature of the ζ phase and becomes lower than the peritectic temperature during natural cooling. Although the peritectic temperature of the ζ phase is 530° C. in the Zn—Fe binary alloy phase diagram, the ζ phase is not likely to generate as a primary crystal in an Al-containing bath at a temperature of not less than 500° C.

It is preferred from the viewpoint of growth suppression of the Γ phase to shorten the retention time after heating, and to cool promptly. In particular, the alloying temperature is not lower than 470° C. to not higher than 600° C. and more preferably not lower than 500° C. to not higher than 530° C. The retention time is not longer than 25 seconds, more preferably not longer than 5 seconds. The cooling speed during natural cooling is not higher than 25° C./sec, more preferably not lower than 4° C./sec to not higher than 8° C./sec. The galvanizing layer is preferably cooled to about 350° C.

As second aspect, the steel sheet may be pre-plated with Ni in an amount of not less than 0.10 g/m$^2$ and not more than 0.50 g/m$^2$, and then, a heating pattern of "rapidly heating at a high temperature using an electric induction heater or the like and then natural cooling, gas-water cooling or the like" may be employed during an alloying process with the total Al concentration in the galvanizing bath being not less than 0.16% by mass and not more than 0.20% by mass. Since the Al concentration in the bath is high, it is preferred that the alloying temperature is determined to be as high as not lower than 510° C. to not higher than 560° C., the retention time is determined to be not longer than 3 seconds, the cooling speed during the natural cooling is determined to be not less than 2° C./sec and not more than 4° C./sec and cooled to about 450° C., and then mist-cooled. According to the second aspect, as compared with the first aspect, even if the Γ phase is equivalent in thickness, the ζ phase can be reduced in amount. Therefore, an extended range for achieving press forming where neither wrinkles nor fractures occur can be provided.

In either aspect, it is important to employ a heating pattern of rapidly heating at a high temperature and then natural cooling, gas-water cooling or the like. An undesirable heating pattern in which the sheet is heated at a low temperature and kept at such temperature for a while may produce sheets with an undesirable ratio of the Γ phase and the ζ phase, for example, the Γ phase becomes excessively thick with no remaining ζ phase, or the Γ phase is thin with an excessively large amount of the ζ phase.

Next, manufacturing conditions of the lubricating coat of the galvanized steel sheet according to the embodiments of the invention will be described. The lubricating coat according to the embodiments of the invention includes the inorganic oxoacid salt and the metallic oxide in a mixed state. Such a coat configuration is established by roll-coating using a treating solution which includes components of an inorganic oxoacid saltand a metallic oxide while controlling concentration and the sheet temperature of the galvanized steel sheet to a suitable range. A reverse roll-coating may alternatively be employed.

As preferred examples of the component which generates the inorganic oxoacid salt, P-containing oxygen acid (phosphoric acid, phosphorous acid, hypophosphorous acid or the like), boric acid or the like, and the salts thereof may be used. An oxide colloid of Si, Al, Ti or other elements may be added. As preferred examples of the component which generates the metallic oxide, for example, regarding Mn, an inorganic salt of manganese sulfate, manganese nitrate or permanganate may be used. In addition, oxide or hydroxide of Zn, Al, Ni, Mo, Co, Ni, Ca, V, W, Ti or Ce may be added, and for generating such oxide or hydroxide, metal nitrate salt, carbonate salt, ammonium salt or sulfuric acid salt may be used. In addition, if necessary, sulfuric acid, nitric acid or the like may be added for increasing a stability of the treating solution.

The total concentration of the treating solution is not less than 5 g/l and not more than 30 g/l. The total concentration herein is the sum of the concentration of P, B, Zn, Mn and the like not including oxygen. If the total concentration is less than 5 g/l, production efficiency of the lubricating coat becomes poor which reduces the threading speed. If the total concentration exceeds 30 g/l, excessively uneven distribution is likely to be made in the lubricating coat. The temperature of the treating solution is preferably not less than 10° C. and not more than 50° C. The sheet temperature of the galvanized steel sheet immediately before the coat is formed is not less than 30° C. and not more than 70° C. Such a temperature range is advantageous in dissolving Zn when the sheet is made to contact with the treating solution and in forming a coat and drying the formed coat. If the temperature is below 30° C., fewer effects will be exhibited. If the temperature exceeds 70° C., the amount of dissolved Zn will become excessively large, which weakens the lubricating coat.

In order to make a chemical compound of phosphorus-containing oxoacid and zinc be the major component of Zn in the coat outermost layer, it is desired to increase the concentration of oxygen acid containing P in the treating solution, lower the drying temperature of the coat as low as possible, and shorten the drying time. Preferably, the concentration of oxygen acid containing P is not less than 10 g/l and the coat is dried at a temperature of not more than 60° C. for not longer than 5 seconds. If the above conditions are not applied, zinc oxide to be generated increases in amount.

The steel sheets that can be used in the embodiments of the invention are not to be limited, however, if high press formability is required for the steel sheet, an extremely low carbon steel sheet that is excellent in deep drawability and expandability is particularly preferred. For example, a steel sheet in which Ti or Nb is added to eliminate solute C is properly used, and if necessary, a steel sheet containing P, Mn, Si, B or other elements to reinforce the same can be used. Such steel sheets can achieve the effects of the present invention without any problem. Further, a steel sheet may inevitably include tramp elements, such as Cr, Cu, Ni, and Sn.

The steel sheets according to the embodiments of the present invention can achieve synergistic effects of a lubricating coat structure which includes components with the adhesion-preventing function and components with the rolling-lubricating function in mixed state and a galvanizing layer structure in which a predetermined amount of the ζ phase is made to exist in the surface. Therefore, when compared with the related art steel sheets, an employable range of wrinkle suppressing force, that is, a range for achieving press forming can be extended. As a result, steel sheets in which the value obtained by dividing the lower limit wrinkle suppressing force (β) with which fractures occur by the lower limit wrinkle suppressing force (α) which is required for eliminating wrinkles is preferably more than 1.21, more preferably more than 1.25, more preferably more than 1.27, and further preferably more than 1.30 can be obtained.

Example 1

Next, the invention will be described with reference to examples. The invention, however, is not limited to these examples.

(1) Test Specimens

The composition of sample steel sheets are shown in Table 1. Cold-rolled steel sheets with 0.7 mm thickness were used.

(2) Galvanizing Conditions

The test specimen was degreased, heated to 800° C. in a 4% $H_2$-N2 atmosphere and left for 60 s. Then, the test specimen was air-cooled to 470° C., immersed in a hot-dip galvanizing bath of 460° C. for 3 s and wiped to control the amount. The obtained test specimen was heated and alloyed under the conditions shown in Table 2, which will be described later, air-cooled to 350° C., mist-cooled and then taken out.

(3) Analysis of Galvanizing Layer

The amounts of Zn, Fe, and Al in the galvanizing layer were measured by inductively coupled plasma (ICP atomic emission spectrometry) after the galvanizing layer was dissolved with inhibitor-containing hydrochloric acid to which 0.6% of hexamethylenetetramine manufactured by WAKO Corporation Limited was added. These amounts were summed to obtain the total amount. The value of the above-mentioned Equation relating to the X-ray diffraction intensity ratio I of the ζ phase and the $\delta_1$ phase regarding the ratio of the ζ phase and the $\delta_1$ phase in the galvanizing layer was calculated after the background intensity was removed by the method illustrated in FIG. 1 from the result obtained by the X diffraction. The thickness of the Γ layer was obtained by etching a cross section of the galvanizing layer with, for example, nital (an etching solution consisting of alcohol and nitric acid) and observing the neighborhood of the interface with steel substrate by an optical microscope. For each sample N=3, ten sufficiently spaced normal visual fields were observed and thicknesses thereof were measured to provide an average thickness of the Γ phase.

(4) Conditions for Forming Coat

The treating solutions having a composition shown in Table 2 were used. The galvanized steel sheet was pre-heated to a predetermined temperature and then treated in either of the following manners:

RC: roll coating and then drying (sheet temperature: 50° C.);

Dip: immersing, rinsing and drying (sheet temperature: 50° C.); and

EC: electrolytic treatment, rinsing and drying (sheet temperature: 50° C.).

(5) Analysis of Coat

After the coat was dissolved in a chromic acid solution, the amount of each element was determined by inductively coupled plasma (ICP atomic emission spectrometry). The amount of the inorganic oxoacid salt shown in Table 3 is the sum of the amounts of P and B, and the amount of the metallic oxide shown in Table 3 is the sum of the amounts of Mn, Zn, Al, Ce and Ti.

Figure 3:
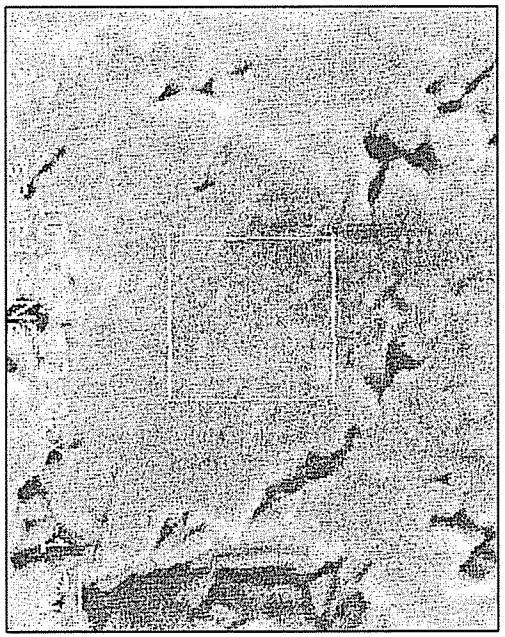
FIG. 3 is an SEM image in which the area where the lubricating coat is analyzed to the depth direction is represented by a white lined box.

The coat structure was subject to depth analysis regarding a region to a depth of 10 nm from the surface layer in a selected area of about 3 μm×3 μm in a flat portion without significant pits and lands of the galvanizing surface layer as illustrated in FIG. 3. At the same time, elemental analysis for each sputtering event (of every 0.1 min) was conducted by AUGER electron spectroscopy at the sputter speed of about 10 nm/min. The state in which P, Mn and Zn are included in a uniform mixture without intentional unevenness as illustrated in FIGS. 2A and 2B and Zn exists even in the coating layer surface is herein referred to as type A. The state in which, as illustrated in Fifth drawing of Patent Document 5, the P-containing component has a peak at the surface layer side and the Mn-containing component has a peak at the inner layer side, which peaks are explicitly different in position, and no Zn exists in the coating layer surface is herein referred to as type B.

Regarding Zn in the coat outermost layer, the spectra illustrated in FIGS. 4 and 5 were obtained by X-ray photoelectron spectroscopy and then examined whether or not Zn exists even in the coat outermost layer and whether Zn in the outermost layer is mainly a chemical compound of phosphorus-containing oxoacid and zinc (P—Zn) or zinc oxide based (ZnO).

(6) Friction Coefficient

The sample with the coat formed thereon was cut into pieces of 17 mm in width and 300 mm in length. NOX RUST®550HN (available from Parker Industries Inc.) was applied to each piece in an amount of 1 g/$m^2$. Then a draw bead test was conducted at a drawing speed of 500 mm/min. The drawing force was measured while varying the pressure force from 200 kgf-800 kgf (i.e., from $1.96\times10^3$N-$7.84\times10^3$N). An inclination is obtained with the pressure force plotted to the horizontal axis and the obtained value was multiplied by ½ to provide the friction coefficient.

(7) Wrinkle Generating Limit and Fracture Generating Limit

The sample with the coat formed thereon was punched to a diameter of 90 mm and then subject to a cylinder-shape forming test with a punch diameter of 50 mm (4R) and a dice diameter of 54 mm (4R). The lower limit force (α) with which wrinkles eliminate and the lower limit force (β) with which fractures occur were obtained while varying the wrinkle suppressing force (blank holder force) from 3 tons to 7 tons (i.e., from $2.94\times10^4$N to $6.93\times10^4$ N).

(8) Chemical Conversion Treatability

The sample with the coat formed thereon was degreased and surface-controlled as prescribed using a commercially-available chemical conversion treatment solution (SD5000 available from Nippon Paint Co., Ltd.). Subsequently, the sample was subject to a chemical conversion treatment. The sample was observed by SEM, determined to be "good" if it has a uniform coat and determined to be "fair" if it has an uncoated portion in a section of an area rate not more than 10%.

(9) Comparative Material

Comparative materials having no coating thereon (32 and 33 in Table 3) and a comparative material having, instead of the coating, 3 g/$m^2$ of Fe—Zn electroplating (Fe: 80%) (34 in Table 3) were prepared.

TABLE 1

| Steel | C | Si | Mn | P | S |
|---|---|---|---|---|---|
| I | 0.001 | 0.011 | 0.11 | 0.005 | 0.004 |
| II | 0.002 | 0.005 | 0.64 | 0.025 | 0.007 |

TABLE 2

| Treating solution | Inorganic oxide | Metallic oxide |
|---|---|---|
| ① | Phosphoric acid | Manganese nitrate |
| ② | Phosphoric acid | Permanganate |
| ③ | Phosphoric acid | Manganese sulfate |
| | Boric acid | Sulfate cerium (IV) |
| ④ | Nitric acid | Manganese nitrate |
| | Phosphoric acid | Nickel nitrate |

Figure 7:
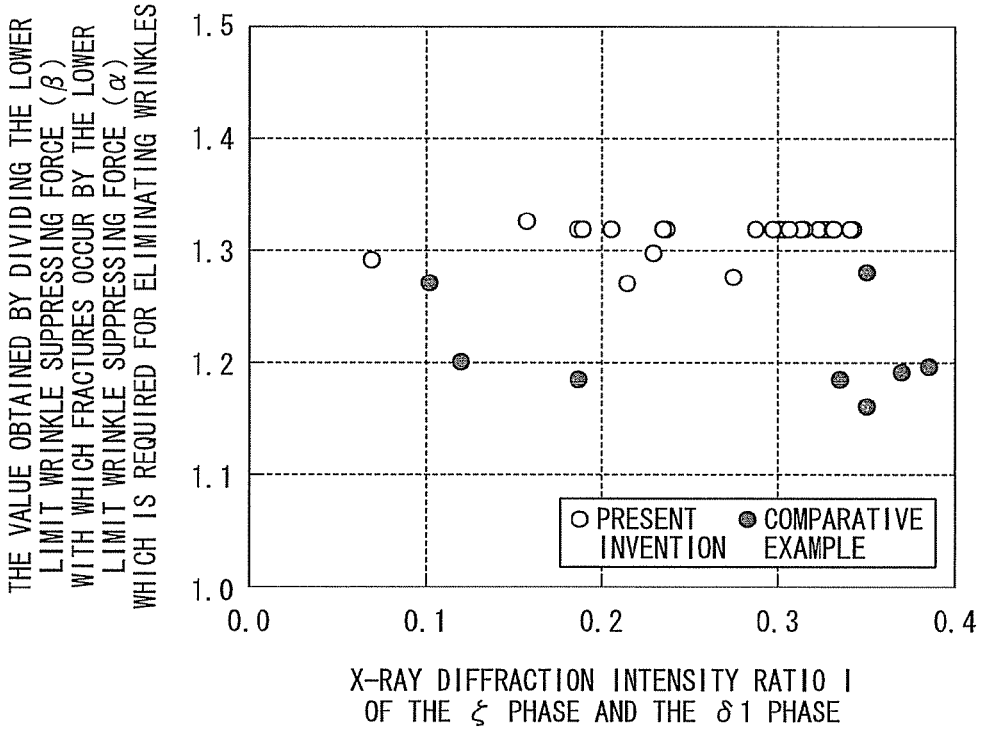
FIG. 7 shows examples of the present invention and comparative examples in Table 3, with the horizontal axis that represents X-ray diffraction intensity ratio I of the ζ phase and the $\delta_1$ phase regarding the ratio of the ζ phase and the $\delta_1$ phase in the galvanizing layer, and the vertical axis that represents the value obtained by dividing the lower limit wrinkle suppressing force (β) with which fractures occur by the lower limit wrinkle suppressing force (α) which is required for eliminating wrinkles.

The performance evaluation results are shown in Table 3. In Table 3, articles 1 to 24 relate to galvanized steel sheets according to an embodiment of the invention and articles 25 to 34 relate to galvanized steel sheets according to comparative examples. FIG. 7 shows examples of the present invention and comparative examples in Table 3, with the horizontal axis that represents X-ray diffraction intensity ratio I of the ζ phase and the $\delta_1$ phase regarding the ratio of the ζ phase and the $\delta_1$ phase in the galvanizing layer, and the vertical axis that represents the value obtained by dividing the lower limit wrinkle suppressing force (β) with which fractures occur by the lower limit wrinkle suppressing force (α) which is required for eliminating wrinkles.

TABLE 3

| | | Configuration of surface treatment | | | | | | | | | | |
|---|---|---|---|---|---|---|---|---|---|---|---|---|
| | | | Galvanizing layer | | | | | Coating layer | | | | |
| | | | | | | | | Inorganic oxide | | Metallic oxide | | |
| Article | Steel | Treating solution | Applied amount ($g/m^2$) | Fe (%) | Al ($g/m^2$) | Value of equation (1) | Γ phase (μm) | Type | Applied amount ($mg/m^2$) | Type | Applied amount ($mg/m^2$) |
| 1 | I | ① | 20 | 10.2 | 0.13 | 0.215 | 0.75 | P | 15 | Mn, Zn, Al | 7 |
| 2 | I | ① | 30 | 10.1 | 0.14 | 0.237 | 0.70 | P | 20 | Mn, Zn, Al | 10 |
| 3 | I | ① | 45 | 10.8 | 0.16 | 0.327 | 0.70 | P | 25 | Mn, Zn, Al | 15 |
| 4 | I | ① | 60 | 9.7 | 0.18 | 0.288 | 0.70 | P | 50 | Mn, Zn, Al | 35 |
| 5 | II | ① | 70 | 11.7 | 0.19 | 0.070 | 1.20 | P | 15 | Mn, Zn, Al | 5 |
| 6 | II | ① | 70 | 9.4 | 0.20 | 0.230 | 0.65 | P | 75 | Mn, Zn, Al | 50 |
| 7 | I | ② | 25 | 9.2 | 0.17 | 0.323 | 0.60 | P | 15 | Mn, Zn, Al | 7 |
| 8 | I | ② | 30 | 9.5 | 0.17 | 0.236 | 0.65 | P | 25 | Mn, Zn, Al | 15 |
| 9 | I | ② | 45 | 9.7 | 0.17 | 0.331 | 0.65 | P | 40 | Mn, Zn, Al | 20 |
| 10 | I | ② | 50 | 9.3 | 0.17 | 0.342 | 0.65 | P | 40 | Mn, Zn, Al | 30 |
| 11 | I | ② | 50 | 10.0 | 0.17 | 0.187 | 0.80 | P | 50 | Mn, Zn, Al | 30 |
| 12 | II | ② | 60 | 9.7 | 0.17 | 0.189 | 0.75 | P | 50 | Mn, Zn, Al | 50 |
| 13 | II | ② | 70 | 9.2 | 0.17 | 0.275 | 0.72 | P | 150 | Mn, Zn, Al | 100 |
| 14 | I | ③ | 70 | 8.8 | 0.22 | 0.158 | 0.45 | P, B | 20 | Mn, Zn, Al, Ce | 20 |
| 15 | I | ③ | 30 | 10.9 | 0.19 | 0.302 | 0.90 | P, B | 35 | Mn, Zn, Al, Ce | 20 |
| 16 | I | ③ | 45 | 9.5 | 0.17 | 0.315 | 0.60 | P, B | 35 | Mn, Zn, Al, Ce | 20 |
| 17 | I | ③ | 50 | 10.1 | 0.18 | 0.332 | 0.85 | P, B | 50 | Mn, Zn, Al, Ce | 25 |
| 18 | I | ③ | 50 | 9.7 | 0.17 | 0.314 | 0.70 | P, B | 50 | Mn, Zn, Al, Ce | 30 |
| 19 | II | ③ | 60 | 9.3 | 0.17 | 0.304 | 0.65 | P, B | 70 | Mn, Zn, Al, Ce | 50 |
| 20 | II | ③ | 70 | 8.5 | 0.17 | 0.206 | 0.45 | P, B | 200 | Mn, Zn, Al, Ce | 150 |
| 21 | I | ④ | 30 | 9.5 | 0.18 | 0.341 | 0.55 | P | 15 | Mn, Zn, Al, Ni | 10 |
| 22 | I | ④ | 50 | 9.5 | 0.17 | 0.298 | 0.60 | P | 20 | Mn, Zn, Al, Ni | 20 |
| 23 | II | ④ | 50 | 9.6 | 0.16 | 0.313 | 0.65 | P | 30 | Mn, Zn, Al, Ni | 20 |
| 24 | II | ④ | 50 | 9.5 | 0.17 | 0.307 | 0.60 | P | 40 | Mn, Zn, Al, Ni | 25 |
| 25 | I | ① | 50 | 8.5 | 0.17 | 0.464 | 0.55 | P | 20 | Mn | 10 |
| 26 | I | ① | 50 | 9.1 | 0.17 | 0.335 | 0.65 | P | 15 | Mn | 7 |
| 27 | I | ② | 50 | 10.0 | 0.17 | 0.187 | 0.70 | P | 17 | Mn | 10 |
| 28 | I | ② | 50 | 11.0 | 0.17 | 0.102 | 1.10 | P | 450 | Mn, Zn, Al | 250 |
| 29 | I | ③ | 50 | 8.8 | 0.17 | 0.350 | 0.65 | P | 25 | Mn | 15 |
| 30 | I | ④ | 50 | 8.1 | 0.17 | 0.414 | 0.60 | P | 25 | Mn, Zn, Al, Ni | 15 |
| 31 | II | ④ | 50 | 8.2 | 0.17 | 0.385 | 0.60 | P | 40 | Mn, Zn, Al, Ni | 20 |
| 32 | I | not applied | 50 | 10.5 | 0.17 | 0.120 | 1.00 | | not applied | | |
| 33 | I | not applied | 50 | 10.2 | 0.17 | 0.370 | 0.70 | | not applied | | |
| 34 | I | not applied | 50 | 10.0 | 0.17 | 0.350 | 0.70 | | not applied | | |

| | Configuration of surface treatment | | Manufacturing method | | | | | | | |
|---|---|---|---|---|---|---|---|---|---|---|
| | Coating layer | | Galvanizing condition | | coating | Performance evaluation result | | | | |
| Article | Coat structure | Surface layer Zn | Total Al concentration in bath (%) | Alloying temperature (° C.) | condition Treat-ment | Friction coeffi-cient | α (ton) | β (ton) | β/α | Chemical conversion treatability |
| 1 | A | ZnO | 0.13 | 500 | RC | 0.150 | 4.8 | 6.1 | 1.27 | Good |
| 2 | A | P—Zn | 0.13 | 510 | RC | 0.155 | 4.7 | 6.2 | 1.32 | Good |
| 3 | A | P—Zn | 0.13 | 520 | RC | 0.150 | 4.7 | 6.2 | 1.32 | Good |
| 4 | A | P—Zn | 0.13 | 530 | RC | 0.140 | 4.7 | 6.2 | 1.32 | Good |
| 5 | A | P—Zn | 0.13 | 550 | RC | 0.140 | 4.8 | 6.2 | 1.29 | Good |

TABLE 3-continued

| | | | | | | | | | | |
|---|---|---|---|---|---|---|---|---|---|---|
| 6 | A | P—Zn | 0.13 | 560 | RC | 0.145 | 4.7 | 6.1 | 1.30 | Good |
| 7 | A | ZnO | 0.14 | 520 | RC | 0.150 | 4.7 | 6.2 | 1.32 | Good |
| 8 | A | P—Zn | 0.14 | 520 | RC | 0.140 | 4.7 | 6.2 | 1.32 | Good |
| 9 | A | P—Zn | 0.14 | 520 | RC | 0.140 | 4.7 | 6.2 | 1.32 | Good |
| 10 | A | P—Zn | 0.14 | 520 | RC | 0.145 | 4.7 | 6.2 | 1.32 | Good |
| 11 | A | P—Zn | 0.14 | 530 | RC | 0.150 | 4.7 | 6.2 | 1.32 | Good |
| 12 | A | P—Zn | 0.13 | 550 | RC | 0.145 | 4.7 | 6.2 | 1.32 | Good |
| 13 | A | P—Zn | 0.13 | 540 | RC | 0.135 | 4.7 | 6.0 | 1.28 | Good |
| 14 | A | P—Zn | 0.13 | 540 | RC | 0.145 | 4.6 | 6.1 | 1.33 | Good |
| 15 | A | P—Zn | 0.15 | 530 | RC | 0.150 | 4.7 | 6.2 | 1.32 | Good |
| 16 | A | P—Zn | 0.14 | 530 | RC | 0.145 | 4.7 | 6.2 | 1.32 | Good |
| 17 | A | P—Zn | 0.14 | 530 | RC | 0.145 | 4.7 | 6.2 | 1.32 | Good |
| 18 | A | P—Zn | 0.13 | 520 | RC | 0.140 | 4.7 | 6.2 | 1.32 | Good |
| 19 | A | P—Zn | 0.13 | 540 | RC | 0.150 | 4.7 | 6.2 | 1.32 | Good |
| 20 | A | P—Zn | 0.13 | 540 | RC | 0.130 | 4.7 | 6.2 | 1.32 | Good |
| 21 | A | ZnO | 0.13 | 500 | RC | 0.150 | 4.7 | 6.2 | 1.32 | Good |
| 22 | A | P—Zn | 0.13 | 520 | RC | 0.145 | 4.7 | 6.2 | 1.32 | Good |
| 23 | A | P—Zn | 0.13 | 550 | RC | 0.145 | 4.7 | 6.2 | 1.32 | Good |
| 24 | A | P—Zn | 0.13 | 540 | RC | 0.140 | 4.7 | 6.2 | 1.32 | Good |
| 25 | B | not exist | 0.13 | 480 | Dip | 0.200 | 4.9 | 5.6 | 1.14 | Good |
| 26 | B | not exist | 0.13 | 480 | Dip | 0.190 | 4.9 | 5.8 | 1.18 | Good |
| 27 | B | not exist | 0.13 | 520 | EC | 0.155 | 4.9 | 5.8 | 1.18 | Good |
| 28 | A | P—Zn | 0.14 | 530 | RC | 0.135 | 4.8 | 6.1 | 1.27 | Fair |
| 29 | B | not exist | 0.14 | 480 | Dip | 0.165 | 5.0 | 5.8 | 1.16 | Good |
| 30 | A | P—Zn | 0.15 | 500 | RC | 0.195 | 4.6 | 5.5 | 1.20 | Good |
| 31 | A | P—Zn | 0.13 | 500 | RC | 0.180 | 4.6 | 5.5 | 1.20 | Good |
| 32 | not applied | | 0.13 | 500 | | 0.155 | 4.5 | 5.4 | 1.20 | Good |
| 33 | not applied | | 0.13 | 480 | | 0.200 | 4.2 | 5.0 | 1.19 | Good |
| 34 | not applied | | 0.13 | 480 | | 0.140 | 5.0 | 6.4 | 1.28 | Good |

The galvanized steel sheets according to the invention have a low friction coefficient, excellent slidability and satisfactory chemical conversion treatability. As compared with the related art, the galvanized steel sheets according to the invention have an extended range for achieving press forming, defined between the wrinkle generating limit and the fracture generating limit.

On the contrary, coating structures of the lubricating coats of the comparative examples 25, 26, 27 and 29 are of type B. Accordingly, the wrinkle generating limit is high and thus the range for achieving press forming is narrower than that of the steel sheet according to an embodiment of the invention. Meanwhile, comparative examples 28, 30 and 31 that have a coating structure of type A, galvanizing layers of these comparative examples 28, 30 and 31 have small chemical conversion treatability due to a large amount of the coating, or do not satisfy the equation regarding the X-ray diffraction intensity ratio I of the ζ phase and the $\delta_1$ phase in the galvanizing layer according to the invention. Accordingly, the fracture generating limit is low and thus the range for achieving press forming is narrower than that of the steel sheet according to an embodiment of the invention.

Example 2

Next, Example 2 will be described that differs from Example 1 in the galvanizing process.

(1) Test Specimen

The composition of sample steel sheets are shown in Table 1. Cold-rolled steel sheets with 0.7 mm thickness were used.

(2) Galvanization Conditions

The test specimen was degreased, washed in acid, and then pre-plated with Ni by electroplating in a Watt bath. The test specimen was then heated to 470° C. in a 4% $H_2$—$N_2$ atmosphere, immersed in a hot dip galvanizing bath of 460° C. for 3 s and then wiped to control the amount. The test specimen was then heated and alloyed under the conditions shown in Table 4, air-cooled to 450° C., subsequently mist-cooled and taken out.

(3) Analysis of Galvanizing Layer

The amounts of Zn, Fe, Al and Ni in the galvanizing layer were measured by inductively coupled plasma (ICP atomic emission spectrometry) after the galvanizing layer was dissolved with inhibitor-containing hydrochloric acid to which 0.6% of hexamethylenetetramine manufactured by WAKO Corporation Limited was added. The amounts of Zn, Fe, Al and Ni were summed to obtain the total amount. Other conditions were the same as in Example 1.

(4) Conditions for Forming the Coat and Coat Analysis

Conditions for forming the coat and the process of the coat analysis were the same as in Example 1.

(5) Performance Evaluation Test

Friction coefficient, wrinkle and fracture generating limits and chemical conversion treatability were similarly evaluated as Example 1.

Figure 8:
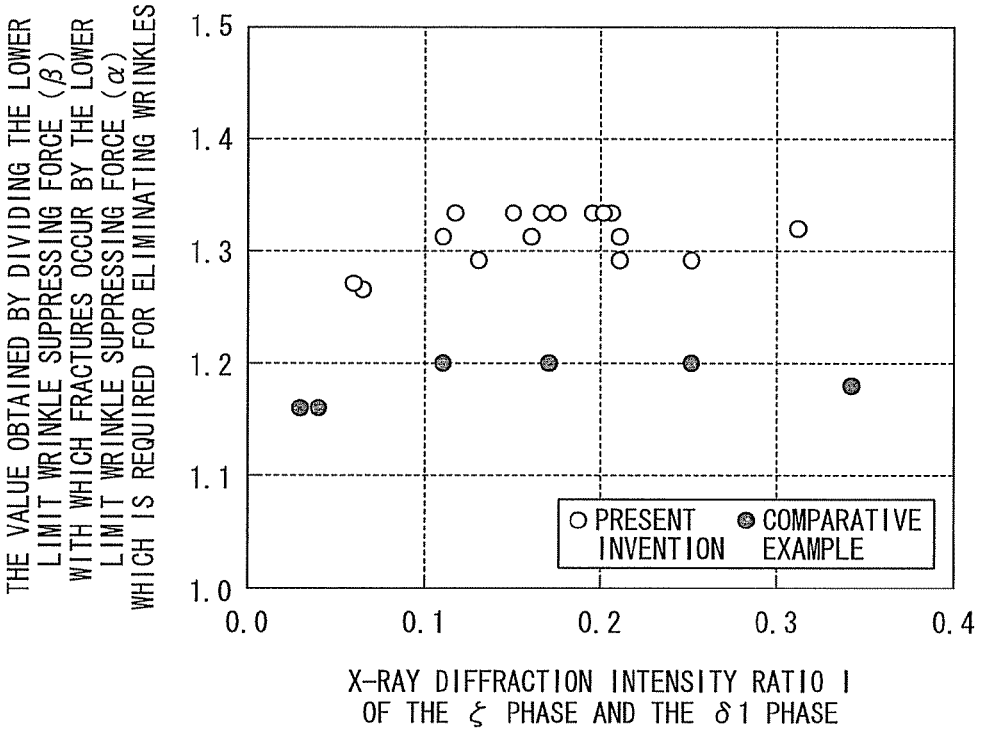
FIG. 8 shows examples of the present invention and comparative examples in Table 4, with the horizontal axis that represents X-ray diffraction intensity ratio I of the ζ phase and the $\delta_1$ phase regarding the ratio of the ζ phase and the $\delta_1$ phase in the galvanizing layer, and the vertical axis that represents the value obtained by dividing the lower limit wrinkle suppressing force (β) with which fractures occur by the lower limit wrinkle suppressing force (α) which is required for eliminating wrinkles.

The performance evaluation results are shown in Table 4. In Table 4, 35 to 50 relate to galvanized steel sheets according to an embodiment of the invention and 51 to 57 relate to galvanized steel sheets according to comparative examples. FIG. 8 shows examples of the present invention and comparative examples in Table 4, with the horizontal axis that represents X-ray diffraction intensity ratio I of the ζ phase and the $\delta_1$ phase regarding the ratio of the ζ phase and the $\delta_1$ phase in the galvanizing layer, and the vertical axis that represents the value obtained by dividing the lower limit wrinkle suppressing force (β) with which fractures occur by the lower limit wrinkle suppressing force (α) which is required for eliminating wrinkles.

TABLE 4

| | | | Configuration of surface treatment | | | | | | | | | |
|---|---|---|---|---|---|---|---|---|---|---|---|---|
| | | | Galvanizing layer | | | | | | Coating layer | | | |
| | | | | | | | | | Inorganic oxide | | Metallic oxide | |
| Article | Steel | Treating solution | Applied amount ($g/m^2$) | Fe (%) | Al ($g/m^2$) | Ni ($g/m^2$) | Value of equation (1) | Γ phase (μm) | Type | Applied amount ($mg/m^2$) | Type | Applied amount ($mg/m^2$) |
| 35 | I | 1 | 20 | 9.0 | 0.19 | 0.21 | 0.250 | 0.60 | P | 15 | Mn, Zn, Al, Ni | 10 |
| 36 | I | 1 | 30 | 9.3 | 0.20 | 0.22 | 0.210 | 0.65 | P | 20 | Mn, Zn, Al, Ni | 15 |
| 37 | I | 1 | 45 | 9.3 | 0.23 | 0.22 | 0.195 | 0.60 | P | 30 | Mn, Zn, Al, Ni | 20 |
| 38 | II | 1 | 60 | 9.6 | 0.26 | 0.23 | 0.174 | 0.65 | P | 50 | Mn, Zn, Al, Ni | 20 |
| 39 | I | 2 | 70 | 9.1 | 0.28 | 0.21 | 0.310 | 0.65 | P | 50 | Mn, Zn, Al, Ni | 30 |
| 40 | I | 2 | 50 | 10.2 | 0.25 | 0.22 | 0.117 | 0.80 | P | 30 | Mn, Zn, Al, Ni | 25 |
| 41 | I | 2 | 50 | 10.5 | 0.25 | 0.21 | 0.065 | 1.00 | P | 35 | Mn, Zn, Al, Ni | 30 |
| 42 | II | 2 | 50 | 10.7 | 0.20 | 0.40 | 0.080 | 1.10 | P | 40 | Mn, Zn, Al, Ni | 30 |
| 43 | I | 3 | 20 | 9.0 | 0.31 | 0.08 | 0.210 | 0.65 | P, B | 15 | Mn, Zn, Al, Ce | 10 |
| 44 | I | 3 | 30 | 9.3 | 0.32 | 0.09 | 0.160 | 0.70 | P, B | 25 | Mn, Zn, Al, Ce | 15 |
| 45 | I | 3 | 45 | 9.2 | 0.35 | 0.10 | 0.205 | 0.60 | P, B | 40 | Mn, Zn, Al, Ce | 20 |
| 46 | II | 3 | 60 | 9.0 | 0.38 | 0.10 | 0.201 | 0.60 | P, B | 50 | Mn, Zn, Al, Ce | 20 |
| 47 | I | 4 | 30 | 10.5 | 0.20 | 0.22 | 0.110 | 0.90 | P | 25 | Mn, Zn, Al, Ni | 25 |
| 48 | I | 4 | 45 | 9.7 | 0.23 | 0.21 | 0.166 | 0.65 | P | 30 | Mn, Zn, Al, Ni | 30 |
| 49 | I | 4 | 60 | 10.2 | 0.26 | 0.21 | 0.150 | 0.70 | P | 35 | Mn, Zn, Al, Ni | 35 |
| 50 | II | 4 | 70 | 9.3 | 0.40 | 0.08 | 0.130 | 0.70 | P | 50 | Mn, Zn, Al, Ni | 40 |
| 51 | I | 1 | 50 | 9.0 | 0.24 | 0.20 | 0.340 | 0.65 | P | 15 | Mn | 5 |
| 52 | I | 2 | 50 | 10.0 | 0.24 | 0.21 | 0.170 | 0.75 | P | 25 | Mn | 10 |
| 53 | I | 3 | 50 | 10.8 | 0.36 | 0.09 | 0.110 | 1.00 | P, B | 25 | Mn | 15 |
| 54 | I | 4 | 50 | 10.1 | 0.24 | 0.21 | 0.250 | 0.70 | P | 20 | Mn | 10 |
| 55 | I | 1 | 50 | 11.6 | 0.39 | 0.10 | 0.040 | 1.30 | P | 20 | Mn, Zn, Al, Ni | 15 |
| 56 | I | 2 | 50 | 11.7 | 0.39 | 0.11 | 0.030 | 1.20 | P | 30 | Mn, Zn, Al, Ni | 15 |
| 57 | I | 4 | 50 | 11.8 | 0.27 | 0.22 | 0.030 | 1.30 | P | 40 | Mn, Zn, Al, Ni | 30 |

| | Configuration of surface treatment | | Manufacturing method | | | | | | | | |
|---|---|---|---|---|---|---|---|---|---|---|---|
| | | | Galvanizing condition | | | | | | | | |
| | Coating layer | | Ni | | | Coating | Performance evaluation result | | | | |
| Article | Coat structure | Surface layer Zn | pre-plating ($g/m^2$) | Total Al concentration in bath | Alloying temperature (° C.) | condition Treat-ment | Friction coeffi-cient | α (ton) | β (ton) | β/α | Chemical conversion treatability |
| 35 | A | ZnO | 0.30 | 0.18 | 510 | RC | 0.135 | 4.8 | 6.2 | 1.29 | Good |
| 36 | A | P—Zn | 0.30 | 0.18 | 520 | RC | 0.129 | 4.8 | 6.3 | 1.31 | Good |
| 37 | A | P—Zn | 0.30 | 0.18 | 540 | RC | 0.135 | 4.8 | 6.4 | 1.33 | Good |
| 38 | A | P—Zn | 0.30 | 0.18 | 540 | RC | 0.120 | 4.8 | 6.4 | 1.33 | Good |
| 39 | A | P—Zn | 0.30 | 0.18 | 540 | RC | 0.150 | 4.7 | 6.2 | 1.32 | Good |
| 40 | A | P—Zn | 0.30 | 0.19 | 550 | RC | 0.130 | 4.8 | 6.4 | 1.33 | Good |
| 41 | A | P—Zn | 0.30 | 0.19 | 560 | RC | 0.120 | 4.9 | 6.2 | 1.27 | Good |
| 42 | A | P—Zn | 0.50 | 0.19 | 540 | RC | 0.135 | 4.8 | 6.1 | 1.27 | Good |
| 43 | A | ZnO | 0.15 | 0.18 | 500 | RC | 0.132 | 4.8 | 6.2 | 1.29 | Good |
| 44 | A | P—Zn | 0.15 | 0.18 | 510 | RC | 0.127 | 4.8 | 6.3 | 1.31 | Good |
| 45 | A | P—Zn | 0.15 | 0.18 | 530 | RC | 0.120 | 4.8 | 6.4 | 1.33 | Good |
| 46 | A | P—Zn | 0.15 | 0.18 | 530 | RC | 0.115 | 4.8 | 6.4 | 1.33 | Good |
| 47 | A | P—Zn | 0.30 | 0.18 | 530 | RC | 0.125 | 4.8 | 6.3 | 1.31 | Good |
| 48 | A | P—Zn | 0.30 | 0.18 | 540 | RC | 0.120 | 4.8 | 6.4 | 1.33 | Good |
| 49 | A | P—Zn | 0.30 | 0.18 | 540 | RC | 0.140 | 4.8 | 6.4 | 1.33 | Good |
| 50 | A | P—Zn | 0.15 | 0.18 | 540 | RC | 0.140 | 4.8 | 6.2 | 1.29 | Good |
| 51 | B | not exist | 0.30 | 0.18 | 480 | Dip | 0.160 | 5.0 | 5.9 | 1.18 | Good |
| 52 | B | not exist | 0.30 | 0.18 | 500 | Dip | 0.140 | 5.0 | 6.0 | 1.20 | Good |
| 53 | B | not exist | 0.15 | 0.18 | 550 | EC | 0.120 | 5.0 | 6.0 | 1.20 | Good |
| 54 | B | not exist | 0.30 | 0.19 | 500 | EC | 0.150 | 5.0 | 6.0 | 1.20 | Good |
| 55 | A | P—Zn | 0.15 | 0.20 | 550 | RC | 0.110 | 5.0 | 5.8 | 1.16 | Good |
| 56 | A | P—Zn | 0.15 | 0.20 | 550 | RC | 0.110 | 5.0 | 5.8 | 1.16 | Good |
| 57 | A | P—Zn | 0.30 | 0.20 | 550 | RC | 0.100 | 5.0 | 5.8 | 1.16 | Good |

The galvanized steel sheets according to the invention have a low friction coefficient, excellent slidability and satisfactory chemical conversion treatability. As compared with the comparative examples (i.e., the related art), the galvanized steel sheets according to the invention have an extended range for achieving press forming, defined between the wrinkle generating limit and the fracture generating limit. As compared with the galvanized steel sheet according to an embodiment of the invention shown in Table 3 (Example 1), the galvanized steel sheet of Example 2 has an extended range for achieving press forming.

INDUSTRIAL APPLICABILITY

In the present invention, both the component having the adhesion-preventing function and the component having the rolling-lubricating function are mixed into the entire lubricating coat even in the outermost layer thereof, and in addition, Zn in the lubricating coat is provided even in the outermost layer. A predetermined amount of the ζ phase is made to exist on the surface of the galvanizing layer. A synergistic effect generated by the lubricating coat and the galvanizing layer can extend the range for which the galvanized steel sheet can be press formed. As a result, a higher yield can be obtained in the press forming of steel sheets for automobile bodies and the steel sheets can be produced more efficiently than in the related art. In addition, the possibility of the die and punch design can be expanded to produce variously designed press-formed articles, thereby providing automobiles of increased commercial value. Accordingly, the present invention has wide industrial applicability.

BRIEF DESCRIPTION OF REFERENCE SYMBOLS

K1: line representing background intensity having peak 19 corresponding to $\delta_1$ phase K2: line representing background intensity having peak 20 corresponding to phase L: line representing intensity of $\delta_1$ (d=0.127 nm) after removal of background intensity in $\delta_1$ phase M: line representing intensity of ζ (d=0.126 nm) after removal of background intensity in phase

1: galvanized steel sheet

2: steel sheet

3: galvanizing layer

4: amorphous coating layer (lubricating coat)

The invention claimed is:

1. A galvanized steel sheet comprising:

a steel sheet; and a galvanizing layer in an amount of not less than 20 g/m$^2$ and not more than 100 g/m$^2$, the galvanizing layer being provided on a surface of the steel sheet and containing Zn as a main component, wherein the galvanizing layer includes an amorphous coating layer having an inorganic oxoacid salt and metallic oxide on a surface layer of the galvanizing layer;

the inorganic oxoacid salt includes oxygen acid salts containing P;

the metallic oxide includes:

oxides or hydroxides of Zn; and one or more selected from oxides and hydroxides which contain one or more of Al, Mn, Mo, Co, Ni, Ca, V, W, Ti, and Ce;

the galvanizing layer includes a ζ phase and a $\delta_1$ phase;

the galvanizing layer includes, by mass, 8 to 13% of Fe;

Zn in the metallic oxide exists up to an outermost surface layer of the amorphous layer;

50% or more of Zn by atomic percent existing in the outermost layer of the amorphous coating layer is present as a chemical compound of phosphorus-containing oxoacid and zinc; and an X-ray diffraction intensity ratio I, which is obtained by dividing an X-ray diffraction intensity of the ζ phase at d=0.126 nm, after removing background intensity, by an X-ray diffraction intensity of the δ 1 phase at d=0.127 nm, after removing background intensity, is 0.06 to 0.35.

2. The galvanized steel sheet according to claim 1, wherein the galvanizing layer includes a Γ phase, and wherein the Γ phase has an average thickness of 1.5 μm or less.

3. The galvanized steel sheet according to claim 1, wherein the galvanizing layer includes Al in an amount of not less than 0.10 g/m$^2$ and not more than 0.25 g/m$^2$.

4. The galvanized steel sheet according to claim 1, wherein the galvanizing layer includes Ni in an amount of more than 0 g/m$^2$ and not more than 0.40 g/m$^2$.

5. The galvanized steel sheet according to claim 4, wherein the galvanizing layer includes Al in an amount of not less than 0.15 g/m$^2$ and not more than 0.45 g/m$^2$.

6. The galvanized steel sheet according to any one of claims 1 to 5, wherein the inorganic oxoacid salt further includes one or more selected from boric acid salts and oxide collides which contain one or more of Si, Al, and Ti.

7. The galvanized steel sheet according to any one of claims 1 to 5, wherein the metallic oxide includes at least one of metallic oxides of Mn and Al.

8. The galvanized steel sheet according to any one of claims 1 to 5, wherein:

a total amount of P and B in the inorganic oxoacid salt is not less than 1 mg/m$^2$ and not more than 250 mg/m$^2$; and a total amount of Mn, Mo, Co, Ni, Ca, V, W, Ti and Ce in the metallic oxide including Zn is not less than 1 mg/m$^2$ and not more than 250 mg/m$^2$.

9. The galvanized steel sheet according to claim 2, wherein the Γ phase has an average thickness of 0.45 μm to 1.5 μm.

* * * * *

UNITED STATES PATENT AND TRADEMARK OFFICE

CERTIFICATE OF CORRECTION

PATENT NO. : 8,852,753 B2
APPLICATION NO. : 13/521302
DATED : October 7, 2014
INVENTOR(S) : Matsumura Kenichiroh et al.

It is certified that error appears in the above-identified patent and that said Letters Patent is hereby corrected as shown below:

In the Specification

Column 11, line 9, change "amount of the phase" to -- amount of the ς phase --;

Column 14, line 3, change "3 μm×3 μm" to -- 3 μm × 3 μm --;

Column 16, Table 3, for Article 24, under column Γ phase (μm), change "0.60" to -- 0.65 --;

Column 21, line 24, change "corresponding to phase" to -- corresponding to ς phase --; and Column 21, line 28, change "intensity in phase" to -- intensity in ς phase --.

Signed and Sealed this
Twelfth Day of May, 2015

Michelle K. Lee

Michelle K. Lee
*Director of the United States Patent and Trademark Office*